US005320746A

United States Patent [19]

Green et al.

[11] Patent Number: 5,320,746

[45] Date of Patent: Jun. 14, 1994

[54] PROCESS FOR RECOVERING OIL FROM TAR SANDS

[75] Inventors: Robert C. Green, Berkeley Heights, N.J.; Gordon F. Stuntz; Russell J. Koveal, both of Baton Rouge, La.

[73] Assignee: Exxon Research and Engineering Company, Florham Park, N.J.

[21] Appl. No.: 608,130

[22] Filed: Nov. 1, 1990

[51] Int. Cl.[5] ..... C10G 1/04

[52] U.S. Cl. ..... 208/391

[58] Field of Search ..... 208/391

[56] References Cited

U.S. PATENT DOCUMENTS

| | | | |
|---|---|---|---|
| 3,449,211 | 4/1967 | Gorand et al. | 208/391 |
| 3,530,042 | 11/1967 | Graybill et al. | 208/391 |
| 4,337,143 | 6/1982 | Hanson et al. | 208/391 |
| 4,514,305 | 4/1985 | Filby | 208/391 |
| 4,648,964 | 3/1987 | Leto et al. | 208/391 |

OTHER PUBLICATIONS

Kirk-Othmer Encyclopedia of Chemical Technology 2nd Ed. 1969 vol. 19, pp. 723-731.

*Primary Examiner*—Paul Lieberman
*Assistant Examiner*—Kopel
*Attorney, Agent, or Firm*—Roy J. Oh

[57] ABSTRACT

A process for recovering oil from tar sands by subjecting the tar sands to aqueous extraction to produce a bitumen-rich layer containing bitumen, water and solids and a bitumen-lean layer containing relatively less bitumen and relatively more water and solids. The solids present in the bitumen-lean layer contain a substantial portion of finely divided clay having adhered organic matter. The clay solids are retained with the bitumen from the bitumen-lean layer and the bitumen-clay mixture is pyrolyzed. Pyrolysis of the bitumen-lean layer containing clay having adhered organic matter reduces the volume of aqueous tailings which would otherwise be produced and also results in increased hydrocarbon yields.

5 Claims, 1 Drawing Sheet

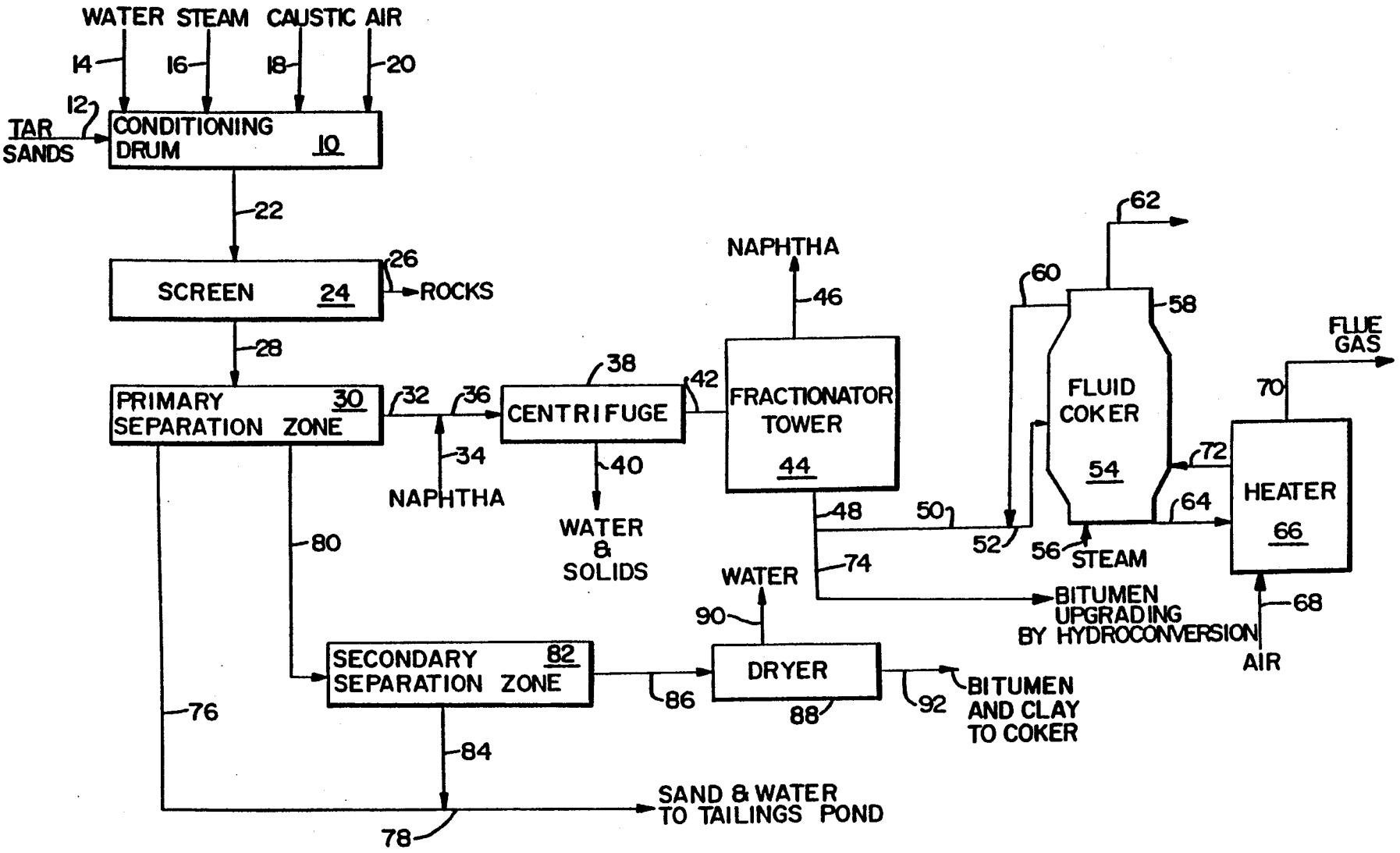
TAR SANDS
12
WATER
14
STEAM
16
CAUSTIC
18
AIR
20
CONDITIONING DRUM
10
22
SCREEN
24
26
ROCKS
28
PRIMARY SEPARATION ZONE
30
32
36
NAPHTHA
34
CENTRIFUGE
38
40
WATER & SOLIDS
42
FRACTIONATOR TOWER
44
NAPHTHA
46
48
50
52
60
FLUID COKER
54
58
62
56
STEAM
64
72
HEATER
66
68
AIR
70
FLUE GAS
74
BITUMEN UPGRADING BY HYDROCONVERSION
80
SECONDARY SEPARATION ZONE
82
84
86
DRYER
88
90
WATER
92
BITUMEN AND CLAY TO COKER
76
78
SAND & WATER TO TAILINGS POND

PROCESS FOR RECOVERING OIL FROM TAR SANDS

BACKGROUND OF THE INVENTION

1. Field of the Invention

This invention relates to a process for recovering oil from tar sands. More particularly, the invention relates to a process whereby tar sands are extracted with water to produce a bitumen-rich layer and a bitumen-lean layer containing relatively more water and solids than the bitumen-rich layer and the bitumen-lean layer containing solids including clay having adhered organic matter is sent to a pyrolysis zone to provide for increased oil recovery.

2. Description of the Prior Art

Among the many approaches considered for separating the hydrocarbon fraction from tar sands, the aqueous extraction process represents a well-developed recovery technique. Typically, the tar sands are contacted with hot or cold water to form (i) a bitumen-rich layer containing bitumen, water and solids including sand and clay having adhered organic matter, (ii) a bitumen-lean layer containing relatively less bitumen and more water and solids than the bitumen rich layer and (iii) precipitated, relatively bitumen free sands. The water and solids are separated from the bitumen-lean layer and the resulting bitumen-lean stream is combined with the bitumen-rich layer which is thereafter diluted with naphtha, allowed to settle and then centrifuged to remove water and residual solids. After removal of the diluent, the bitumen is fed to a pyrolysis unit wherein the bitumen is heated to form distilled and cracked products including vaporized liquid oil products, normally gaseous products and carbon which is deposited on solids present in the pyrolysis zone.

One of the principle disadvantages of the tar sands hot and cold water extraction processes is the enormous volume of aqueous tailings. These tailings contain a stable suspension of inorganic fines. Since no economically viable schemes have been devised for removing these suspended fines, the tailings are held in sludge ponds which are both a major expense and potentially an environmental hazard.

A further disadvantage of the aqueous extraction process is the loss of oil present as adhered organic matter in the finely divided clay which is in admixture with the separated sands. The presence of organics in these clays is reported in Energy and Fuels 1988(3) 386–391.

Various solvent extraction schemes have been proposed as alternatives to the aqueous extraction of tar sands. For example, Hanson discloses in U.S. Pat. No. 4,071,433 a liquid slurry process for extracting tar sands in which the tar sands are slurried with an oil and divided in a centrifuge into streams containing course and fine sands. The fine sands stream is fed to a coker where the fines act as a nuclei in coke formation. The course sands stream is filtered by means of a hot oil filter and subsequently dried. Similarly, Irani et al. disclose in U.S. Pat. No. 4,036,732 the use of a $C_5$–$C_9$ paraffin hydrocarbon solvent for the countercurrent extraction of tar sands.

Other references describe a non-extraction method for removing oil by the direct distillation of oil from bituminous sand in a fluidized solids bed. For example, Peterson and Gishler describe in The Petroleum Engineer, April, 1951, at pages 66–74 a fluidized solids technique for recovering oil from Alberta bituminous sand. In this process, raw bituminous sand is fed into a fluidized solids bed to distill and crack the bitumen present in the bituminous sand.

A review of the various known processes for recovering oil from tar sands is given by Chrones and Germain in their article entitled Bitumen and Heavy Oil Upgrading in Canada, Fuel Science and Technology International, 7(5–6), 783–821(1989).

SUMMARY OF THE INVENTION

A process for producing hydrocarbons from tar sands which comprises:

(a) contacting the tar sands with water to extract bitumen therefrom by forming (i) a bitumen-rich layer containing bitumen, water and solids including sand and clay having adhered organic matter, (ii) a bitumen-lean layer containing relatively less bitumen and relatively more water and solids than the bitumen rich layer and (iii) precipitated, relatively bitumen-free sands;

(b) introducing the bitumen-rich layer into a pyrolysis zone containing fluidized solids so that the bitumen is heated to form vaporized liquid oil products, normally gaseous products and carbon which is deposited on the solids present therein;

(c) introducing the bitumen-lean layer containing solids including clay having adhered organic matter into a pyrolysis zone containing fluidized particles so that the bitumen and organic matter present therein is heated to form vaporized liquid oil products, normally gaseous products and carbon which is deposited on the solids present therein;

(d) heating the carbon-containing solids from the pyrolysis zone in a combustion zone in the presence of oxygen to form hot solids and hot flue gas; and (e) introducing the hot solids from the combustion zone into the pyrolysis zone to supply heat.

In a further embodiment of the invention, the hot flue gas from the combustor is used to dry the bitumen-lean layer containing solids including clay having adhered organic matter and the resultant bitumen clay mixture is sent to a pyrolysis zone which may be the same or different as the pyrolysis zone used to convert the bitumen-rich stream. In another embodiment of the invention, the bitumen-rich layer is extracted with a solvent, such as naphtha, distillate, gas oils and the like, to facilitate removal of the water and solids, e.g., by centrifugation, and a dried substantially solids-free bitumen is recovered for further processing.

The process of the present invention avoids or reduces the principle disadvantages resulting from water extraction, solvent extraction or pyrolysis of raw, i.e., unextracted tar sands. Pyrolysis of bitumen-lean layer resulting from water extraction without substantial removal of the fine clay solids contained therein reduces the volume of aqueous tailings containing a stable suspension of these fines. Further, introduction of the clay fines into the pyrolysis zone results in an increased hydrocarbon liquid yield. The present invention may also avoid the expense and inconvenience of using organic solvents. The present invention also substantially reduces the amount of sands which must be handled in the pyrolysis zone, as contrasted with fluidized bed retort processes utilizing raw tar sands.

BRIEF DESCRIPTION OF THE DRAWING

The FIGURE is a schematic illustration of a preferred embodiment of the invention.

DETAILED DESCRIPTION OF THE INVENTION

The process of the invention is conveniently understood by reference to the FIGURE which schematically depicts a preferred embodiment. The description is given for purposes of illustration and is not intended to limit the invention thereto.

In the FIGURE, raw tar sands fed by line 12 are mixed in one or more revolving drums depicted as Conditioning Drum 10 with water, steam, caustic, such as sodium hydroxide, and air (optional) which are introduced via lines 14, 16, 18, and 20, respectively. In general, water is mixed with tar sands at a water/solids weight ratio of 5/1 to 1/5, e.g. a 1/1 water/solids ratio. The water temperature employed for extraction in Conditioning Drum 10 may range from about 32° F.–212° F., preferably from about 70° F.–200° F., e.g., about 160° F., which causes small globules of bitumen to form. The resulting thick liquid slurry is sent to Screen 24 via line 22 to remove rocks and lumps of clay and tar sand which are removed by line 26.

The screened slurry is then sent via line 28 to Primary Separation Zone 30 where most of the bitumen rises to the surface as a froth layer containing primarily bitumen with lesser amounts of water and solids. Typically, the froth layer will contain about 5–90 weight percent bitumen, about 5 to 35 weight percent water, and about 1 to 25 weight percent solids including sand and clay. For example, the froth layer removed from Primary Separation Zone 30 via line 32 may contain 66 weight percent bitumen, 27 weight percent water and 7 weight percent solids.

The bitumen-rich stream from the Primary Separation Zone may be sent, preferably after drying, to a pyrolysis zone such as a fluid coker to form vaporized liquid oil products. In a preferred embodiment, the bitumen-rich layer is conventionally mixed with naphtha introduced via line 34 and the resulting mixture is introduced into Centrifuge 38 via line 36 wherein the bitumen dissolved in the naphtha is removed via line 42 and sent to Fractionation Tower 44 to fractionate the naphtha from the bitumen. Water, solids and some naphtha is removed from Centrifuge 38 via line 40. Naphtha is removed from the Fractionation Tower via line 46 for further use. Bitumen is recovered via line 48 and sent for further processing in a pyrolysis zone, such as a coker, and/or sent to a hydroconversion zone for upgrading.

The sand which has sank to the bottom of Primary Separation Zone 30 is removed along with excess water via lines 76 and 78 for storage in the tailings pond. In between the bitumen-rich layer and the precipitated sand and excess water is a mixture of clay, bitumen and water called "middlings". The middlings layer is removed via line 80 and sent to Secondary Separation Zone 82. Typically, the middlings layer will contain about 50–90 weight percent water, 1–15 weight percent bitumen and 10–60 percent solids including clay having adhered organic matter. For example, the middlings layer, i.e., bitumen-lean layer, may contain 73 weight percent water, 2 weight percent bitumen and 25 percent solids. The solids in the bitumen-lean layer may comprise from about 50–95 weight percent of a finely divided clay. Some of the water and sand are removed from the Secondary Separation Zone via lines 84 and 78. Much of the finely divided clay, being hydrophobic, remains with the bitumen and is removed from the Secondary Separation Zone via line 86 and then sent to Dryer 88 for further removal of water via line 90. The bitumen and clay having adhered organic matter is then sent to Fluid Coker 54 or some other pyrolysis zone to recover hydrocarbons from the bitumen and clay containing adhered organic matter. Introduction of the clay fines into the Fluid Coker or pyrolysis zone results in an increased hydrocarbon liquid yield and a reduction in the volume of aqueous tailings containing a stable suspension of these fines.

In Fluid Coker 54, bitumen introduced via line 52 and optionally line 92 and coke particles introduced via line 72 are contacted with a fluidizing gas, such as steam, introduced via line 56. The bitumen and other organic matter undergo extensive cracking and distillation on contact with the hot fluid bed. Vaporized products are passed through a cyclone (not shown) to remove entrained solids which are returned to the coking zone through a dipleg (not shown). Vapors from the Fluid Coker leave the cyclone and pass into Scrubber 58 mounted on the coking reactor. Products boiling, for example, below 975° F. are withdrawn via line 62 for fractionation in a conventional manner. The fraction boiling above the product withdrawn via line 62 may be recycled to the Fluid Coker via lines 60 and 52.

Coke produced in Fluid Coker 54 is deposited thereon on the fluidized solids present therein which are sent via line 64 to Heater 66. The coked solids from the Fluid Coker are heated in Heater 66 in the presence of oxygen supplied via line 68 to form hot coked solids and hot flue gas. Fuel may be added (not shown) to supply additional heat in Heater 66. The hot solids from Heater 66 are introduced into Fluid Coker 54 via line 72 to supply heat for the pyrolysis of the bitumen and other organic matter present in the Fluid Coker. The flue gas from Heater 66 is withdrawn via line 70. In a preferred embodiment, flue gas from the Heater is used for indirect contact with water to make steam which can be used to supply heat to Dryer 88.

The conditions in Fluid Coker 54 and Heater 66 are adjusted to provide a proper heat and materials balance in accordance with known conditions such as, for example, disclosed in U.S. Pat. Nos. 4,055,484; 4,057,487 and 4,077,869 which are incorporated herein by reference.

By way of example, the fluidizing gas is admitted at the base of the Fluid Coker in an amount sufficient to obtain superficial fluidizing gas velocity in the range of 0.5 to 5 feet per second. The temperature in the Heater is maintained usually in the range of 1050°–1500° F. so that the heated solids are at least 100° F. higher than the temperature in the Fluid Coker. Heated solids from the Heater are admitted to the Fluid Coker in an amount sufficient to maintain the pyrolysis temperature in the range of about 850° to about 1050° F. The pressure in the Fluid Coker may be maintained in the range of about 5 to about 150 lbs. per square inch (psig), usually in the range of about 5 to about 45 psig. Coked solids from the Fluid Coker are heated with sufficient air in the Heater to attain the desired temperature.

The process and advantage of the invention are further illustrated by the following.

EXAMPLE I

Athabasca bituminous sand from Alberta, Canada is extracted with toluene using a Dean-Stark separator to determine the bitumen, i.e., toluene soluble hydrocarbons present therein. The toluene-bitumen solution is then evaporated to drive off the toluene and isolate the bitumen. It is found that the bituminous sand contains about 10 weight percent bitumen on a dry basis.

The toluene insoluble solids are separated according to particle size and analyzed and found to have the analysis shown in the following Table 1.

TABLE 1

| TOLUENE INSOLUBLE SOLIDS CONTAIN ORGANICS | | |
|---|---|---|
| Fraction | Wt % of Solids | Wt % Organics |
| Sand(1) | 91.6 | 0.0 |
| Clay(2) | 7.8 | 6.8 |

(1)44–250 microns
(2)below 44 microns

It is seen from the above table that bituminous sands contain a significant portion of organics in addition to the bitumen. Most of this organic matter adheres to the clay fines which are ordinarily discarded as a result of aqueous extraction of the bituminous sands, followed by solvent dilution of the bitumen layer and settling out of the solids.

In accordance with the present invention, the clay fines are retained with the bitumen in the middlings or bitumen-lean layer following aqueous extraction of the tar sands. The bitumen-lean layer containing clay having adhered organic matter is processed in a pyrolysis zone such as a fluid coker or retort. Inclusion of the fine clays in the pyrolysis zone results in an increase in the amount of oil recovered from the bituminous sands. Further, reducing the level of clay which would otherwise be discarded with the aqueous stream reduces the volume of aqueous tailings containing a stable suspension of clay fines.

EXAMPLE II

A sample of Athabasca oil sands was Soxlet extracted in conjunction with a Dean-Stark separator with boiling toluene. The resulting assay was (all in weight percent): bitumen 11.50, solids 87.47, and water 1.03. The solids were wet sieved to separate them into various size fractions. The material passing through the finest sieve, 635 US Std. Mesh, was centrifuged to obtain two fractions, a sediment layer called the −635 mesh fraction, and an unsettled solid identified as Suspended Fines. The fraction of organic material on each fraction was also determined. These data are shown in Table 2. For this particular sample, the toluene insoluble organics represented about 5 weight percent of the total organic material in the oil sand. For oil sands containing more fines (defined as material passing 325 mesh) the amount of toluene insoluble organics is larger and represents a larger fraction of the total organics in the oil sand.

TABLE 2

| Toluene Insoluble Organics in Whole Athabasca Oil Sand | | | |
|---|---|---|---|
| Solids Mesh Size US Std Sieve | Wt % of Total | Wt % Organic in Fraction | Wt % Organic of Total in Oil Sand |
| +60 | 0.82 | 6.13 | 0.34 |
| −60/+200 | 78.81 | 0.0 | 0.0 |
| −200/+325 | 1.06 | 1.28 | 0.11 |
| −325/+635 | 0.92 | 1.29 | 0.10 |
| −635 | 4.29 | 6.31 | 2.24 |
| Susp. Fines | 1.57 | 16.90 | 2.20 |
| Total | 87.47 | — | 4.99 |

What is claimed is:

1. A process for producing hydrocarbons from tar sands which comprises:
   (a) contacting the tar sands with water to extract bitumen therefrom by forming (i) a bitumen-rich layer containing bitumen, water and solids including sand and clay having adhered organic matter, (ii) a bitumen-layer containing relatively less bitumen and relatively more water and solids than the bitumen-rich layer and (iii) precipitated, relatively bitumen-free sands;
   (b) introducing the bitumen-rich layer into a pyrolysis zone containing fluidized solids so that the bitumen is heated to form vaporized liquid oil products, normally gaseous products and carbon which is deposited on the solids present therein;
   (c) introducing the bitumen-lean layer containing about 10–60 wt. % solids including clay having adhered organic matter into a pyrolysis zone containing fluidized solids so that the bitumen and organic matter present therein is heated to form vaporized liquid oil products, normally gaseous products and carbon which is deposited on the solids present therein;
   (d) heating the carbon-containing solids from the pyrolysis zone in a combustion zone in the presence of oxygen to form hot solids and hot flue gas; and
   (e) introducing the hot solids from the combustion zone into the pyrolysis zone to supply heat.

2. The process of claim 1 wherein water is removed from the bitumen-rich layer prior to its introduction into the pyrolysis zone.

3. The process of claim 2 wherein at least a portion of the sand present in the bitumen-lean layer is removed and the bitumen-lean layer is dried prior to its introduction into the pyrolysis zone.

4. The process of claim 3 wherein the bitumen-rich layer of step (a) is contacted with a diluent to dissolve the bitumen present therein, water and solids are separated from the bitumen dissolved in the diluent, and the diluent is removed from the bitumen diluent mixture to produce bitumen which is thereafter introduced into a pyrolysis zone having fluidized solids therein to form vaporized liquid oil products, normally gaseous products and carbon which is deposited on the solids present therein.

5. The process of claim 4 wherein the dried bitumen-lean layer having sand removed therefrom is introduced into the pyrolysis zone used to upgrade the bitumen from the bitumen-rich layer.

* * * * *